US005813532A

United States Patent [19]

Kheradpir et al.

[11] Patent Number: 5,813,532

[45] Date of Patent: Sep. 29, 1998

[54] ROUTER BIT CASE

[75] Inventors: Kamyar Kheradpir, Greenville, N.C.; Cliff J. Von Hoene, Jeffersontown, Ky.; Grover C. Haddock; Paul J. Simon, both of Greenville, N.C.

[73] Assignee: Credo Tool Company, Woodburn, Oreg.

[21] Appl. No.: 727,734

[22] Filed: Oct. 8, 1996

[51] Int. Cl.[6] ..... B65D 85/24

[52] U.S. Cl. ..... 206/379; 206/493; 206/777; 220/377

[58] Field of Search ..... 206/308.1, 372–379, 206/777, 493; 220/377

[56] References Cited

U.S. PATENT DOCUMENTS

| | | | |
|---|---|---|---|
| 2,645,337 | 7/1953 | Stenger | 206/777 |
| 2,792,935 | 5/1957 | Rocchetti | 206/379 |
| 3,236,366 | 2/1966 | Broda et al. | 206/379 |
| 3,370,697 | 2/1968 | Levey et al. | 206/375 |
| 3,804,238 | 4/1974 | Howard . | |
| 4,285,556 | 8/1981 | Loeffel | 206/372 |
| 4,293,074 | 10/1981 | Dunsky . | |
| 4,361,226 | 11/1982 | Travis | 206/777 |
| 4,834,237 | 5/1989 | Henke et al. . | |
| 4,958,732 | 9/1990 | Rau et al. . | |
| 4,993,552 | 2/1991 | Bugbey et al. | 206/308.1 |
| 5,114,007 | 5/1992 | Chen . | |
| 5,145,064 | 9/1992 | Chen . | |
| 5,257,695 | 11/1993 | Henke et al. . | |
| 5,429,235 | 7/1995 | Chen . | |
| 5,526,929 | 6/1996 | Wei | 206/378 |

*Primary Examiner*—Jimmy G. Foster
*Attorney, Agent, or Firm*—McDermott, Will & Emery

[57] ABSTRACT

The invention is directed towards a storage case formed from an upper shell, a lower shell and an insertable tray. The insertable tray is removably positioned in an opening in the lower shell. The insertable tray contains supports for tools and parts such as router bits. When the upper shell, lower shell and insertable tray are joined a convenient storage case is formed. Alternatively, the insertable tray can be detached from the lower shell and used to store the tools and parts in a readily accessible manner.

6 Claims, 10 Drawing Sheets

ROUTER BIT CASE

BACKGROUND OF THE INVENTION

The present invention is directed to a storage case for tools and/or parts such as router bits. More particularly, the present invention is directed to a storage case which provides for both convenient transportation and storage of tools and parts as well as the ability to hang up or mount the tools and/or parts for improved access.

Storage cases are commonly formed with internal permanently attached trays in which the tools and/or parts are stored. A problem associated with storage cases utilizing internal permanently attached trays is the difficulty of retrieving and returning tools and/or parts from the trays. Each time a tool and/or part needs to be retrieved the storage case must be opened and the correct tray accessed. This is timely and requires the reservation of valuable work space to enable the opening of the storage case, particularly when multiple storage cases are utilized simultaneously.

The object of the present invention is to provide a storage case that provides storage for multiple tools and/or parts and further provides the advantages of improved access for the retrieval and return of tools and/or parts and eliminates the need to reserve valuable work space.

SUMMARY OF THE INVENTION

According to the present invention there is provided a storage case that comprises an upper shell and a lower shell hinged to each other and an insertable tray removably positioned in an opening in the lower shell. When the upper shell, lower shell and the insertable tray are joined they form a convenient carrying storage case. Alternatively, the insertable tray may be detached from the lower shell and used independently to mount and store tools and/or parts in a reduced space with improved accessibility.

The insertable tray and lower shell are shaped in order to enable the insertable tray to be removably positioned in the opening of the lower shell. The insertable tray is removably positioned in the opening by first sliding it into the opening of the lower shell and second securing it using retaining elements attached to the lower shell.

As pointed out in greater detail below the storage case of the present invention provides the important advantages of an improved access to tools and/or parts and the reduction of the space required for storage and access during periods of use.

The invention itself, together with further objects and attendant advantages, will best be understood by reference to the following detailed description taken in conjunction with the accompanying drawings.

DESCRIPTION OF THE PREFERRED EMBODIMENTS

Figure 1:
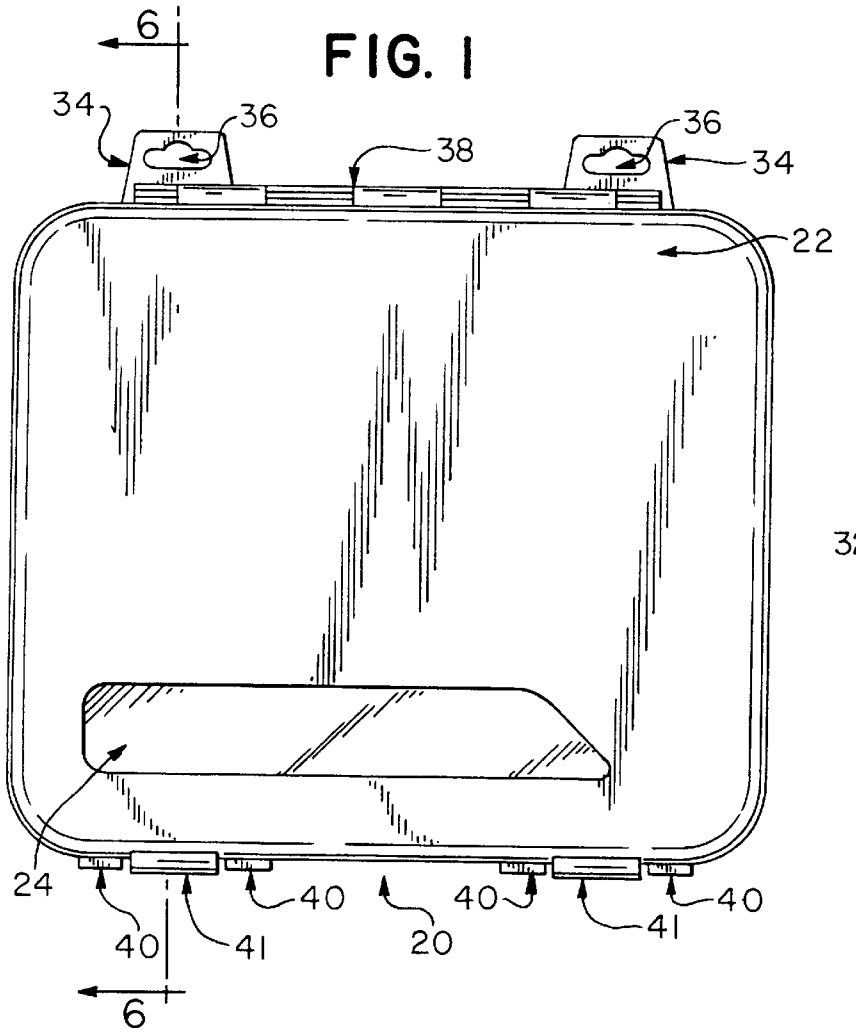
FIG. 1 illustrates a top view of the storage case in a closed position.

Turning now to the drawings, FIG. 1 shows the storage case 20 of the present invention. An upper shell 22 forms the top half of the storage case 20. The upper shell 22 optionally may include a window opening 24 for viewing the contents of the storage case.

Figure 2:
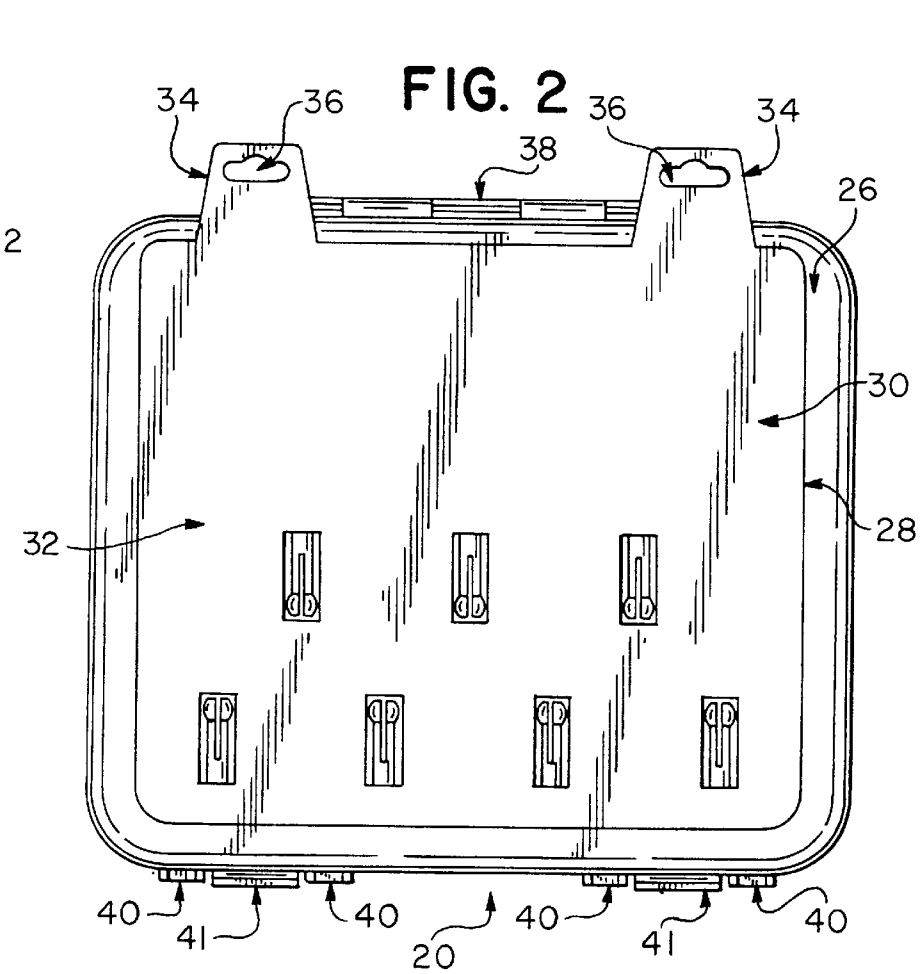
FIG. 2 illustrates a bottom view of the storage case of the present invention in a closed position.

As illustrated in FIG. 2, a lower shell 26 forms the bottom half of the storage case. The lower shell 26 includes an opening 28 in which is removably positioned an insertable tray 30. The insertable tray 30 forms a substantial portion of the outer external surface 32 of the storage case. The insertable tray 30 has at least one projection 34 extending outwards. The projections 34 are formed with apertures 36 configured to allow the storage case 20 as a whole or the insertable tray 30 alone to be mounted on a wall or other vertical surface (not shown). Mounting of the insertable tray 30 independently of the storage case 20 provides for improved access to the stored objects and a decrease in the space taken up during storage.

Figure 3:
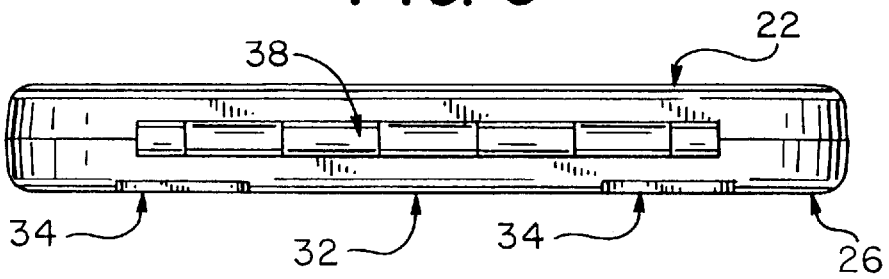
FIG. 3 illustrates a back view of the storage case in a closed position.
Figure 4:
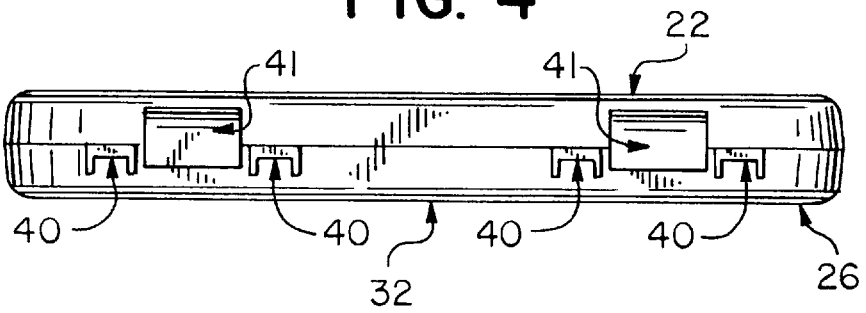
FIG. 4 illustrates a front view of the storage case in a closed position.
Figure 5:
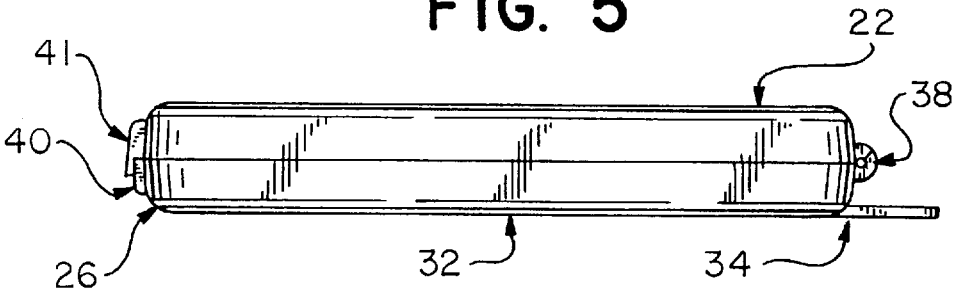
FIG. 5 illustrates a right side view of the storage case in a closed position.
Figure 6:
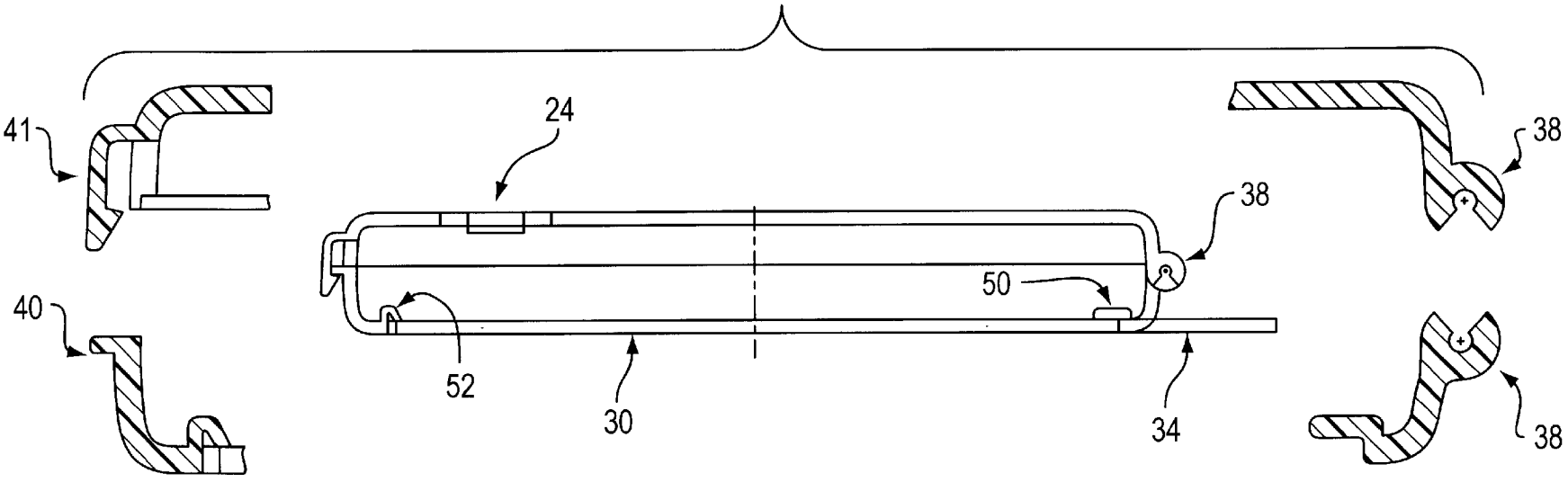
FIG. 6 illustrates a cutaway view of the storage case taken at line 6—6 including exploded views of the preferred case closure elements and hinge extensions.

As shown in FIGS. 3, 4 and 5, the upper shell 22 and the lower shell 26 are rotationally attached to each other using hinges 38 and are maintained in a closed position by closure elements 40 attached to the lower shell 26 and by closure elements 41 attached to the upper shell 22. FIG. 6 shows the hinges 38 and closure elements 40,41 of the preferred embodiment.

Figure 7:
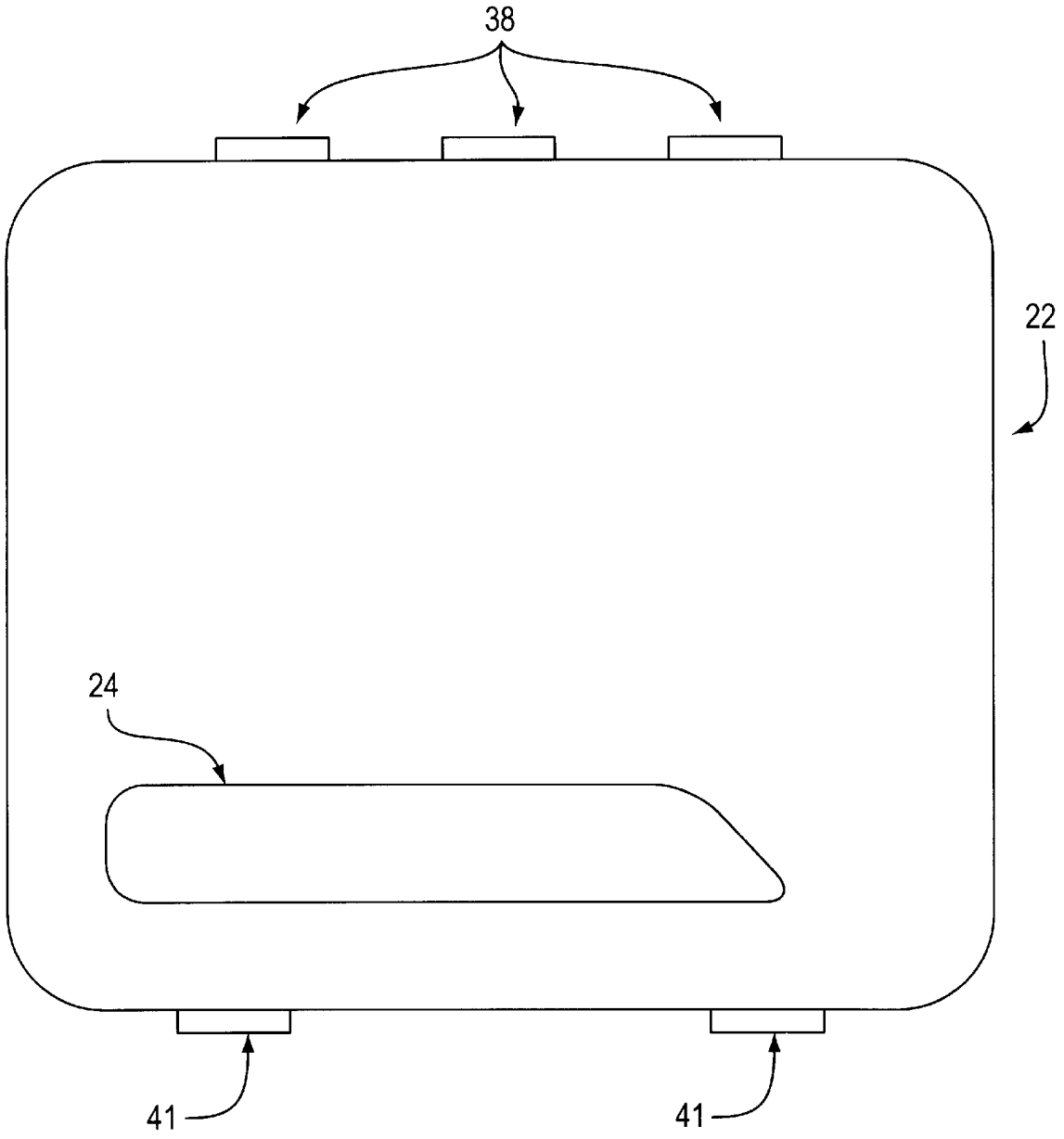
FIG. 7 illustrates a top view of the upper shell.
Figure 8:
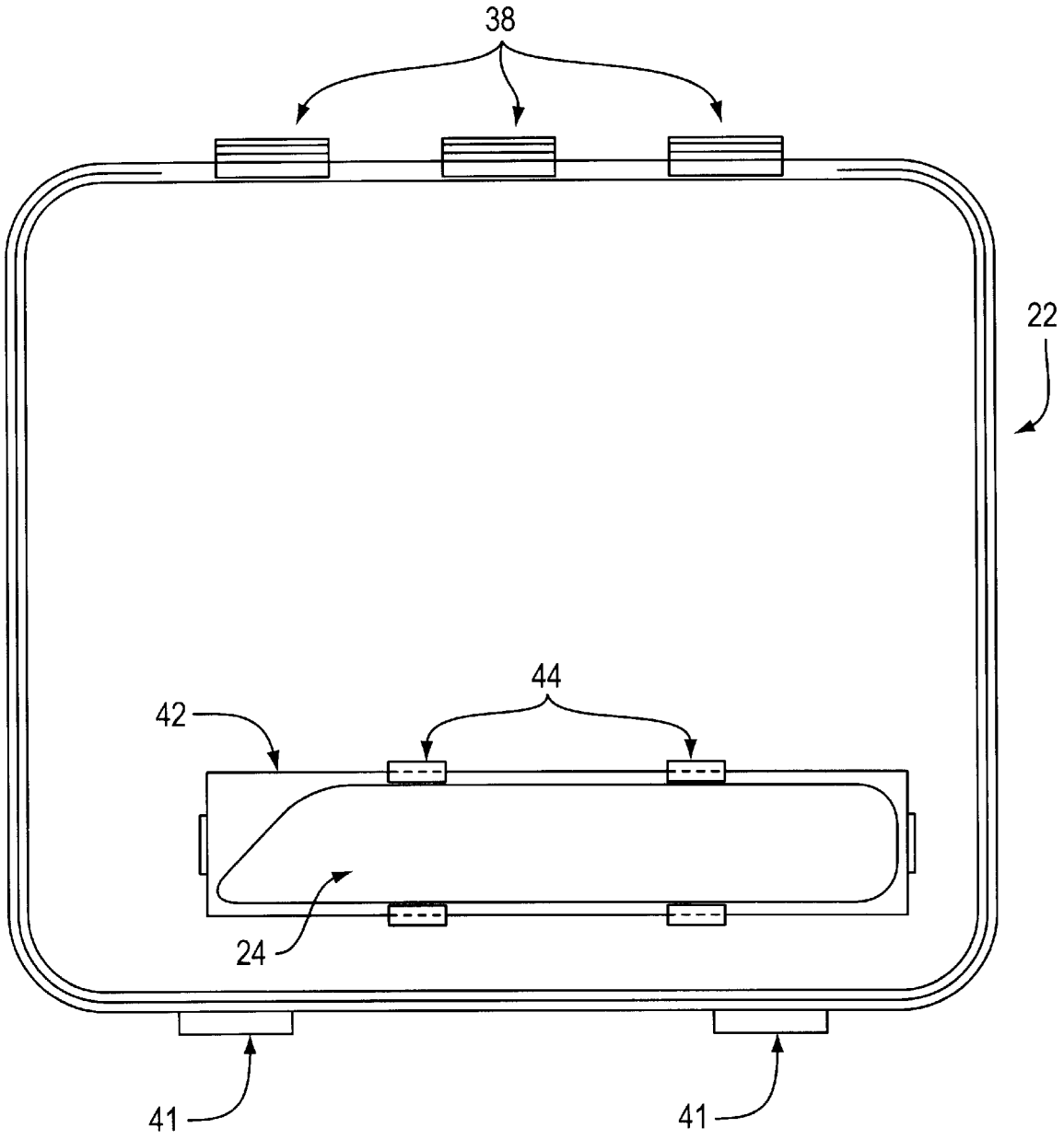
FIG. 8 illustrates a bottom view of the upper shell.

The upper shell 22, as shown in FIGS. 7 and 8, optionally includes a window pane 42 retained against the window opening 24 by window pane retaining elements 44 attached to the upper shell 22.

Figure 9:
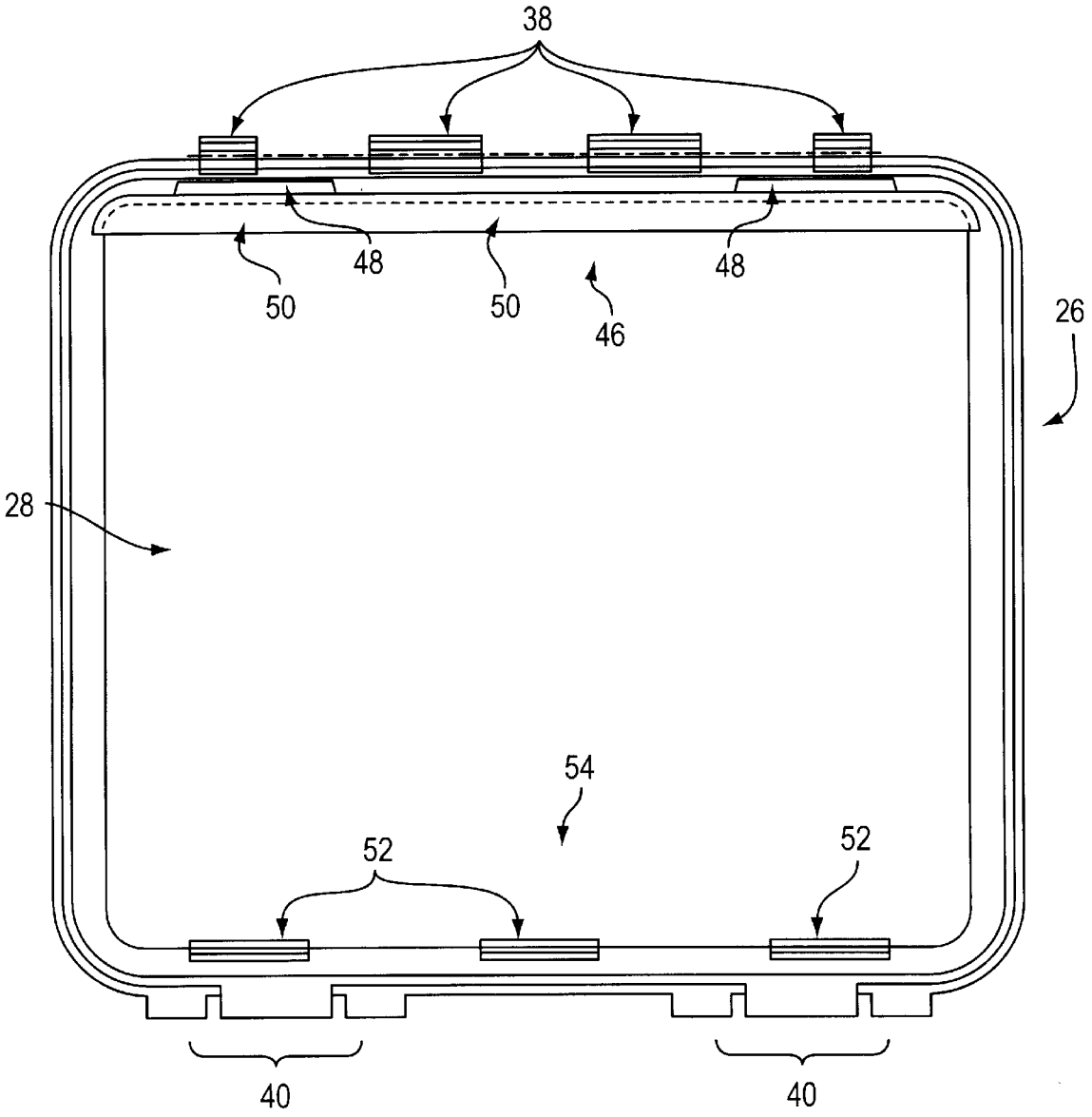
FIG. 9 illustrates a top view of the lower shell with the insertable tray removed.

FIG. 9 illustrates the lower shell 26 with the insertable tray 30 removed. Located at a first end 46 of the lower shell opening 28 are recesses 48 configured to receive the projections 34 of the insertable tray 30. The lower shell 26 further includes a stepped edge 50 at the first end 46 of the lower shell opening 28. Retaining members 52 are attached to the lower shell 26 at a second opposite end 54 of the lower shell opening 28. The retaining members 52 are used to retain the insertable tray 30 within the lower shell opening 28.

Figure 10:
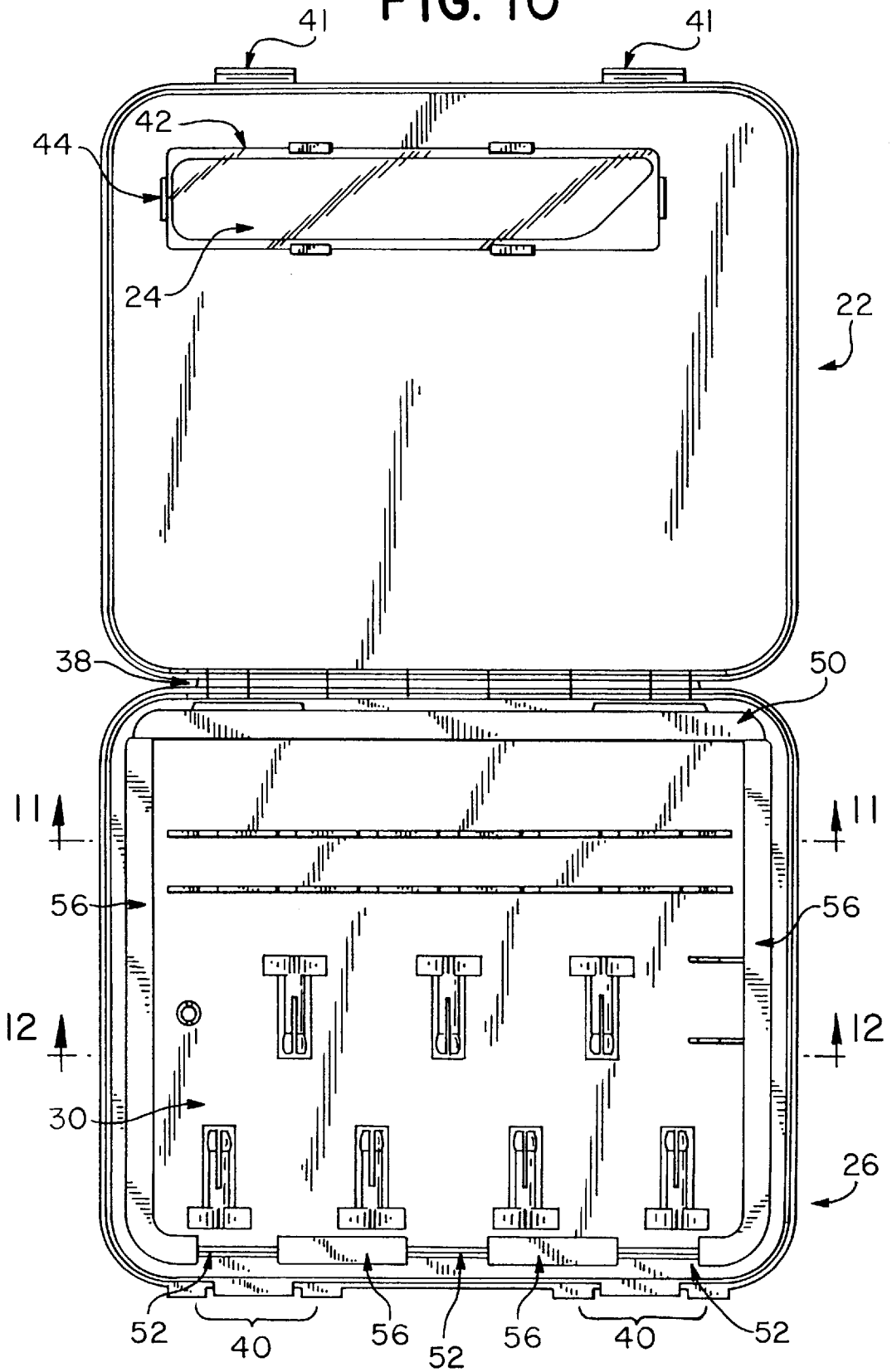
FIG. 10 illustrates the storage case in an open position.

FIG. 10 illustrates the storage case 20 in an open position with the upper shell 22 and lower shell 26 pivoted around the hinges 38. The insertable tray 30 is shown positioned in the lower shell opening 28.

Figure 11:
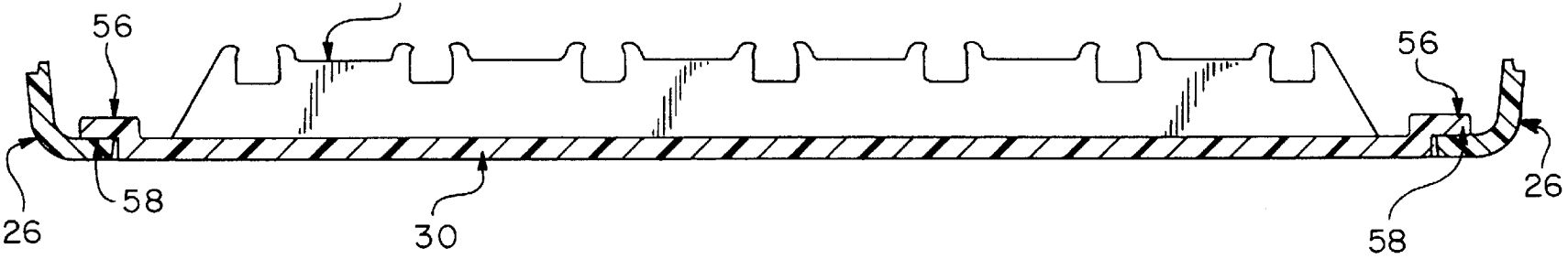
FIG. 11 illustrates a cutaway view of the storage case taken at line 11—11.
Figure 12:
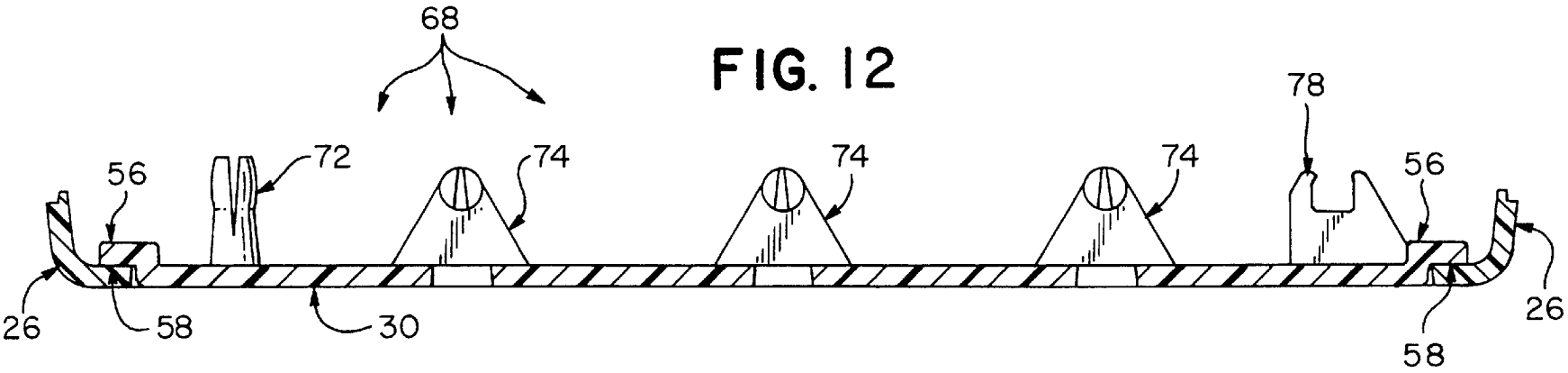
FIG. 12 illustrates a cutaway view of the storage case taken at line 12—12.
Figure 13:
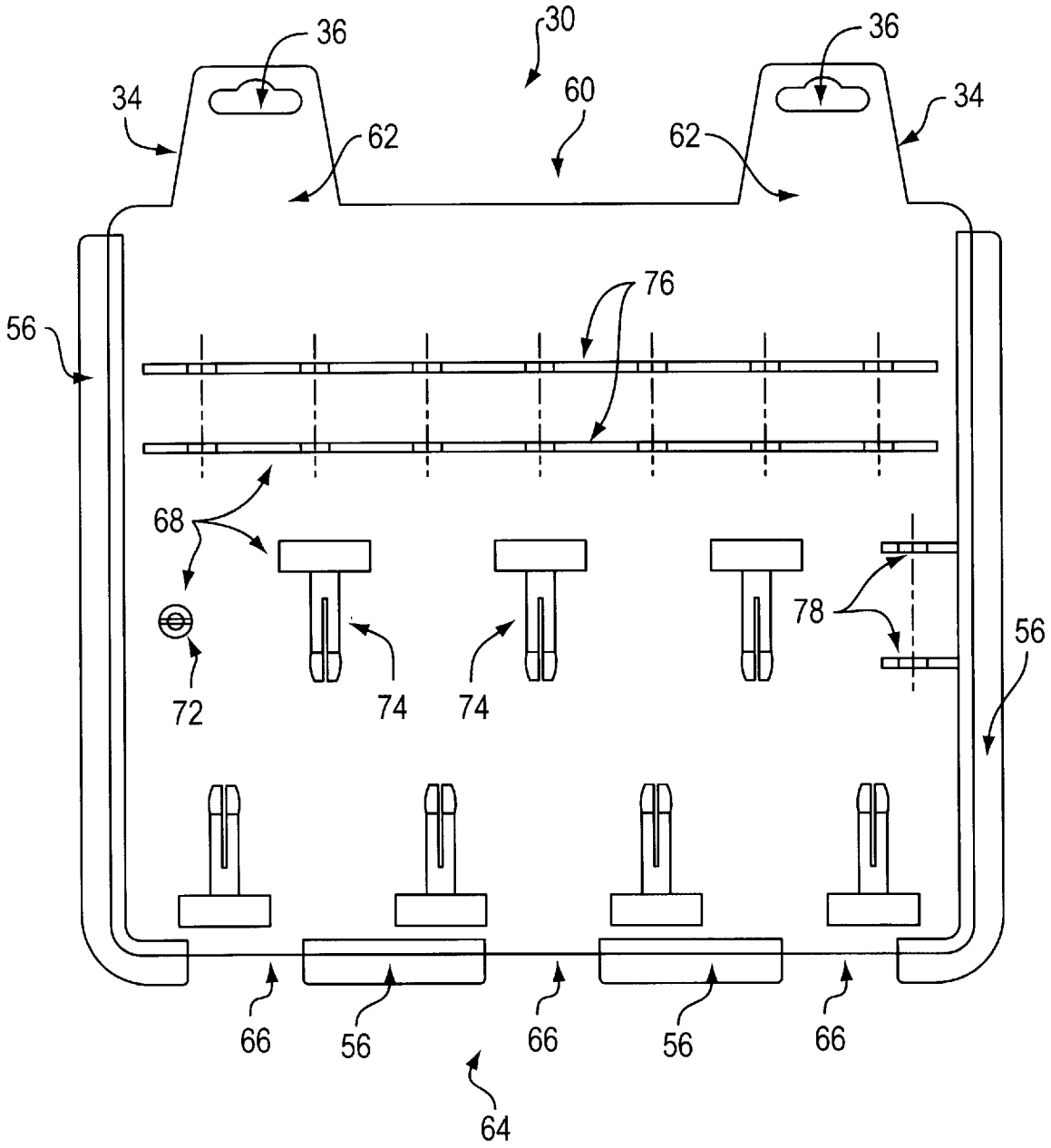
FIG. 13 illustrates a top view of the insertable tray.
Figure 14:
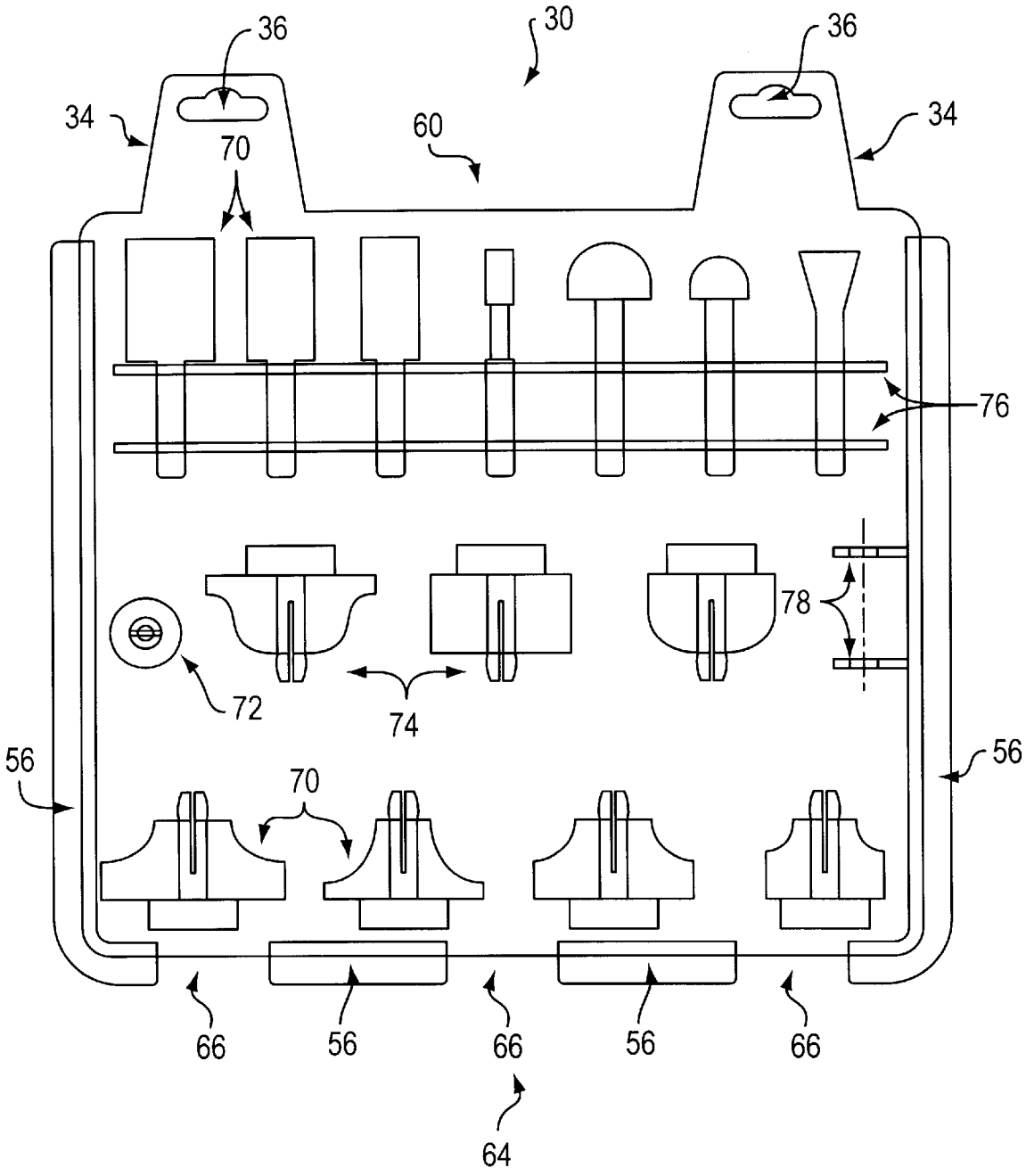
FIG. 14 illustrates a top view of the insertable tray with stored router bits.

Referring to FIGS. 11 and 12, the insertable tray 30 has a stepped edge 56 formed around a portion of its edge. The bottom surface 58 of the stepped edge 56 contacts the lower shell 26. FIG. 13 shows the placement of the projections 34 at a first end 60 of the insertable tray 30. The projections 34 fit in the corresponding recesses 48 of the lower shell 26 with the upper surfaces 62 of the projections 34 contacting the lower shell 26. At a second opposite end 64 of the insertable tray 30 there are notches 66 configured to receive the corresponding retaining members 52 of the lower shell 26.

The insertable tray 30 is removably positioned in the lower shell opening 28, by first sliding the insertable tray 30 into the lower shell opening 28 placing the projections 34 into the corresponding recesses 48 of the lower shell 24 and second securing the insertable tray 30 in position by pushing down on the second end 64 of the insertable tray 30 thereby engaging the retaining members 52 into the corresponding notches 66 in the insertable tray 30. The retaining members 52 bias the insertable tray 30 against the lower shell 26.

As illustrated in FIGS. 11–14 the insertable tray 30 includes at least one support 68 for holding the objects to be stored. The supports 68 of the preferred embodiment are designed to store router bits 70. The supports 68 include a vertical rod support 72, a plurality of raised horizontal rod supports 74, plural tool Supporting parallel rails 76 and singular tool supporting parallel rails 78. It is envisioned that numerous alternative supports could be utilized to store a variety of objects.

Of course, it should be understood that a wide range of changes and modifications can be made to the preferred embodiment described above . It is therefore intended that the foregoing detailed description be understood that it is the following claims, including all equivalents, which are intended to define the scope of this invention.

What is claimed is:

1. A storage case comprising:

an upper shell and a lower shell hinged to each other at respective first ends;

an insertable tray removably positioned in an opening in the lower shell; and the insertable tray forming at least a portion of an outer external surface of the storage case, wherein the insertable tray further comprises at least one projection located in an at least one corresponding recess in the lower shell, at least one support for supporting objects to be stored, and an aperture configured to enable mounting of the insertable tray formed in the at least one projection, said at least one support comprising at least one vertical rod support, a plurality of raised horizontal supports, and at least one set of parallel rail supports.

2. A storage case comprising:

an upper shell and a lower shell rotationally attached to each other;

an insertable tray removably positioned in an opening in the lower shell, wherein the insertable tray further comprises at least one projection, wherein the at least one projection of the insertable tray is located in the an at least one corresponding recess in the lower shell;

an upper surface of the insertable tray contacting the lower shell;

a lower surface of the insertable tray contacting the lower shell;

tray retaining elements attached to the lower shell for biasing the insertable tray against the lower shell; and, the insertable tray forming at least a portion of an outer external surface of the storage case, said insertable tray further comprising at least one support for supporting objects to be stored and a stepped edge forming at least a portion of an edge of the insertable tray, said at least one support comprising at least one vertical rod support, a plurality of raised horizontal rod supports, and at least one set of parallel rail supports, wherein the objects to be stored are router bits.

3. A storage case comprising:

an upper shell and a lower shell hinged to each other at respective first ends;

an insertable tray removably positioned in an opening in the lower shell; and the insertable tray forming at least a portion of an outer external surface of the storage case, wherein the insertable tray further comprises at least one projection located in an at least one corresponding recess in the lower shell, at least one support for supporting objects to be stored and an aperture configured to enable mounting of the insertable tray formed in the at least one projection.

4. A storage case comprising:

A storage case comprising:

an upper shell and a lower shell hinged to each other at respective first ends;

an insertable tray removably positioned in an opening in the lower shell; and the insertable tray forming at least a portion of an outer external surface of the storage case, wherein the insertable tray further comprises at least one projection located in an at least one corresponding recess in the lower shell, and at least one support for supporting objects to be stored, said at least one support comprising at least one vertical rod support, a plurality of raised horizontal supports, and at least one set of parallel rail supports.

5. A storage case comprising:

an upper shell and a lower shell rotationally attached to each other;

an insertable tray removably positioned in an opening in the lower shell, wherein the insertable tray further comprises at least one projection, wherein the at least one projection of the insertable tray located in an at least one corresponding recess in the lower shell;

an upper surface of the insertable tray contacting the lower shell;

a lower surface of the insertable tray contacting the lower shell;

tray retaining elements attached to the lower shell for biasing the insertable tray against the lower shell; and the insertable tray forming at least a portion of an outer external surface of the storage case, said insertable tray further comprising at least one support for supporting objects to be stored and a stepped edge forming at least a portion of an edge of the insertable tray, said at least one support comprising at least one vertical rod support, a plurality of raised horizontal rod supports, and at least one set of parallel rail supports.

6. The storage case of claim 5 wherein the objects to be stored are router bits.

* * * * *